US008400082B2

(12) United States Patent
Lee

(10) Patent No.: US 8,400,082 B2
(45) Date of Patent: Mar. 19, 2013

(54) POWER-SAVING LED LIGHTING APPARATUS

(75) Inventor: Dae Young Lee, Ansan (KR)

(73) Assignee: Luminature Co., Ltd., Yongin (KR)

( * ) Notice: Subject to any disclaimer, the term of this patent is extended or adjusted under 35 U.S.C. 154(b) by 0 days.

(21) Appl. No.: 13/212,043

(22) Filed: Aug. 17, 2011

(65) Prior Publication Data

US 2011/0316432 A1 Dec. 29, 2011

Related U.S. Application Data

(63) Continuation of application No. PCT/KR2010/000114, filed on Jan. 8, 2010.

(30) Foreign Application Priority Data

Feb. 17, 2009 (KR) ..... 10-2009-0013056
Apr. 2, 2009 (KR) ..... 10-2009-0028436

(51) Int. Cl.
*H05B 37/00* (2006.01)
*G05F 1/00* (2006.01)

(52) U.S. Cl. ..... 315/312; 315/291

(58) Field of Classification Search ..... 315/307–308, 315/247, 312, 185 R, 291; 345/82, 204; 362/800

See application file for complete search history.

(56) References Cited

U.S. PATENT DOCUMENTS

| | | | | |
|---|---|---|---|---|
| 7,265,952 | B2 * | 9/2007 | Chiang et al. | 361/8 |
| 7,521,879 | B2 * | 4/2009 | Hong et al. | 315/307 |
| 7,564,198 | B2 * | 7/2009 | Yamamoto et al. | 315/307 |
| 7,638,954 | B2 * | 12/2009 | Kunimatsu et al. | 315/291 |
| 7,741,788 | B2 * | 6/2010 | Ito et al. | 315/247 |
| 2006/0232219 | A1 * | 10/2006 | Xu | 315/209 R |
| 2007/0257623 | A1 * | 11/2007 | Johnson et al. | 315/193 |

FOREIGN PATENT DOCUMENTS

| | | | |
|---|---|---|---|
| JP | 2005-142137 | A | 6/2005 |
| JP | 2008-059811 | A | 3/2008 |
| KR | 10-2001-0093337 | A | 10/2001 |
| KR | 10-0453133 | B1 | 10/2004 |
| KR | 20-0405272 | Y1 | 1/2006 |

* cited by examiner

*Primary Examiner* — Minh D A
(74) *Attorney, Agent, or Firm* — Reinhart Boerner Van Deuren P.C.

(57) ABSTRACT

Disclosed is a power-saving LED lighting apparatus in which the full-wave rectified wave form of the commercial power is used as the driving voltage. The LED lighting apparatus includes a rectifier circuit part which rectifies commercial power and outputs a rectified voltage; a plurality of LED arrays having a plurality of LEDs connected in series and the rectified voltage of the rectifier circuit part is supplied to an anode of the uppermost LED array; a driving part in which one terminal of each switching device for supplying or blocking a driving current to the plurality of LED arrays is connected to each anode of the plurality of LED arrays, and the other terminal thereof is connected to a cathode of the lowermost LED array; and a control part which outputs a control signal for turning on and off the switching devices according to a level of the rectified voltage.

15 Claims, 6 Drawing Sheets

POWER-SAVING LED LIGHTING APPARATUS

CROSS-REFERENCE TO RELATED PATENT APPLICATIONS

This patent application is a Continuation of PCT Application No. PCT/KR2010/000114, filed Jan. 8, 2010, which designated the United States and claims the benefit of Korean Application No. 10-2009-0013056, filed Feb. 17, 2009, and Korean Application No. 10-2009-0028436, filed Apr. 2, 2009, the entire teachings and disclosure of which are incorporated herein by reference thereto.

FIELD OF THE INVENTION

The present invention relates to a power-saving LED lighting apparatus, and more particularly, to a power-saving LED lighting apparatus which can be driven with a full-wave rectified wave form of commercial power as a supply voltage.

BACKGROUND OF THE INVENTION

Recently, as an insufficient supply of oil is gradually real, it is expected that the price of oil is increased. Further, in order to prevent global warming, efforts to reduce $CO_2$ emissions is accelerating internationally.

Therefore, technical development for minimizing a loss of electric power and an environmental problem in an LED lighting apparatus has been continued. Until now, SMPS (Switching Mode Power Supply) is generally applied to the LED lighting apparatus.

In an LED lighting apparatus having the SMPS, since high capacity condenser and transformer are used in the SMPS, an electric power loss of at least 15% or more occurs according to power conversion. That is, since the LED lighting apparatus having the SMPS coverts commercial power into DC voltage, and then uses the DC voltage as a driving voltage, the power efficiency is deteriorated. Further, it is necessary to establish countermeasures against noise such as EMI (Electro-Magnetic Interference) generated by switching.

Furthermore, in LED lighting apparatus having the SMPS, it is difficult to achieve microminiaturization and IC integration thereof due to the high capacity condenser and transformer, and it causes high manufacturing cost.

Meanwhile, FIG. 8 shows the principle of generating a DC voltage using a general full-wave rectifier circuit, and FIG. 9 shows wave forms of current and commercial power supplied to the full-wave rectifier circuit of FIG. 8.

A rectifier circuit part 610 is to full-wave rectify the commercial power, and comprised of a diode D62 612, a diode D64 614, a diode D66 616 and a diode D68 618.

A DC voltage generating part 620 is to drive a circuit of the LED lighting apparatus, and comprised of a resistor R62 622, a zener diode ZD62 624, a condenser C62 626 and a condenser C64 628.

The commercial power shown in FIG. 9*a* is supplied to the rectifier circuit part 610. In case that a rated voltage of the zener diode ZD62 624 is 6V, a voltage Vcc generated from the DC voltage generating part 620 is 6V due to the rated voltage of the zener diode ZD62 624. Meanwhile, when the commercial power shown in FIG. 9*a* is supplied to the rectifier circuit part 610, a value of current flowing through the resistor R62 622 and the condenser C64 628 can be calculated from the current wave form shown in FIG. 9*b*.

If it is designed that the commercial power supplied to the rectifier circuit part 610 is 220V and the current required for the DC voltage generating part 620 is 20 mA, an average value of the current flowing through the resistor R62 622 is also 20 mA. Therefore, an electric power consumed by the resistor R62 622 is about 214V×20 mA, i.e., about 4.28 W.

If the electric power of about 4.28 W is unnecessarily consumed in order to generated the DC voltage required for the LED lighting apparatus, it is against the aim of the LED lighting apparatus, which reduces the power loss, and thus it is required to improve the problem.

BRIEF SUMMARY OF THE INVENTION

An object of an embodiment of the present invention is to provide a power-saving LED lighting apparatus which can be driven with a pulsating state of full-wave rectified wave form of commercial power source as a supply voltage which is not converted into a DC voltage using a condenser.

Another object of an embodiment of the present invention is to provide a power-saving LED lighting apparatus which can generate a DC voltage from the full-wave rectified wave form with minimum power consumption.

To achieve the object of an embodiment of the present invention, an embodiment of the present invention provides a power-saving LED lighting apparatus, including a rectifier circuit part which full-wave rectifies commercial power and outputs a rectified voltage; an LED part in which a plurality of LED arrays having a plurality of LEDs are connected in series and the rectified voltage of the rectifier circuit part is supplied to an anode of the uppermost LED array; a driving part in which one terminal of each switching device for supplying or blocking a driving current to the plurality of LED arrays is connected to each anode of the plurality of LED arrays, and the other terminal thereof is connected to a cathode of the lowermost LED array; and a control part which outputs a control signal for turning on and off the switching devices of the driving part according to a level of the rectified voltage of the rectifier circuit part.

Preferably, the LED lighting apparatus further includes a constant current circuit part which is connected between the rectifier circuit part and the anode of the uppermost LED array of the LED part.

Preferably, the driving part further comprises a level shift circuit which shifts the control signal output from the control part to control the switching devices.

Preferably, the driving part may be comprised of transistors in which the switching devices are connected in parallel.

Preferably, the control part has a plurality of comparators which output a control signal for turning on and off the switching devices of the driving part according to a level of the rectified voltage of the rectifier circuit part.

Preferably, each of the comparators comprises an operational amplifier having an inverting terminal and a non-inverting terminal, and a constant reference voltage is provided at the non-inverting terminal of the operational amplifier, and the rectified voltage of the rectifier circuit part is distributed to the inverting terminal.

Preferably, the voltage supplied to the non-inverting terminal of the operational amplifier is a distributed voltage obtained using resistors which are connected in series between the rectified voltage of the rectifier circuit part and the ground terminal.

Preferably, each of the LED arrays has a plurality of LEDs which are connected in the form of columns and rows of a matrix.

Preferably, a zener diode is further connected to each column of the LEDs, which are connected in the form of columns and rows of the matrix, in a reverse direction.

Further, an embodiment of the present invention provides a power-saving LED lighting apparatus, including an LED part in which a plurality of LED arrays having a plurality of LEDs are connected in series; a rectifier circuit part which full-wave rectifies commercial power and supplied a full-wave rectified voltage to an anode of the uppermost LED array with a ground terminal as a reference point; a DC voltage generating part which generates a DC voltage using one or more voltage-forming LEDs connected between the ground terminal and a cathode of the lowermost LED array of the LED part; a driving part which is provided with switching devices for supplying or blocking a driving current to the plurality of LED arrays; and a control part which outputs a control signal for turning on and off the switching devices of the driving part according to a level of the rectified voltage of the rectifier circuit part.

Preferably, the DC voltage generating part is further provided with a zener diode and a condenser so as to constantly maintain the DC voltage.

Preferably, the DC voltage generating part is further provided with a diode between the condenser and one or more voltage-forming LEDs in order to prevent a charged voltage of the condenser from being discharged by the one or more voltage-forming LEDs.

Preferably, each of the LED arrays has a plurality of LEDs which are connected in the form of columns and rows of a matrix, and a further voltage-forming LED is parallelly connected to the one or more voltage-forming LEDs, and the number of the parallelly connected one or more voltage-forming LEDs is smaller than the number of the parallelly connected LEDs of the LED part.

As described above, since the full-wave rectified wave form of commercial power is used source as the supply voltage without converting into a DC voltage, it is possible to remarkably improve the power factor and also to minimize the loss of electric power.

Further, since an embodiment of the present invention does not need the high capacity condenser and transformer, it is easy to achieve the IC integration, and since there is not the high frequency generating circuit, it is not necessary for the EMI filter as a countermeasure against the noise, and thus it is possible to reduce the manufacturing cost.

Furthermore, since all of the emitter terminals of the switching devices in the driving port are connected with a single point, the loss of electric power is occurred only by a both-end voltage (a voltage between the emitter and the collector) of the switching devices when the switching devices are turned on, thereby minimizing the loss of electric power.

In addition, since the plurality of LEDs in the LED array are arranged in the form of a matrix, it is possible to prevent reduction in the illumination intensity which may be occurred by the disconnection of the LED or the like. And since the zener diode is applied to each column, the driving current can flow, even through all of the LEDs connected in parallel are opened.

Further, since the level shift circuit is used in the driving part, it is possible to prevent the problem which may occur due to the voltage difference between the control part and the driving part.

Further, since the reference voltage is supplied to the non-inverting terminal of the operational amplifier and the voltage depending on the level of rectified voltage is supplied to the inverting terminal, it is easy to detect the level according to the change in the rectified voltage.

Further, since the commercial voltage is distributed using only the LEDs so as to generate the DC voltage, it is possible to reduce the unnecessary power consumption.

Further, in case that the present invention is provided with a separate DC power supply, or the DC power is generated from a typical AC power supply, it is possible to prevent the problem of the inherent power factor and the irrationality in the aspect of power consumption.

BRIEF DESCRIPTION OF THE DRAWINGS

The above and other objects, features and advantages of embodiments of the present invention will become apparent from the following description of preferred embodiments given in conjunction with the accompanying drawings, in which.

DETAILED DESCRIPTION OF THE INVENTION

Hereinafter, the embodiments of the present invention will be described in detail with reference to accompanying drawings.

Figure 1:
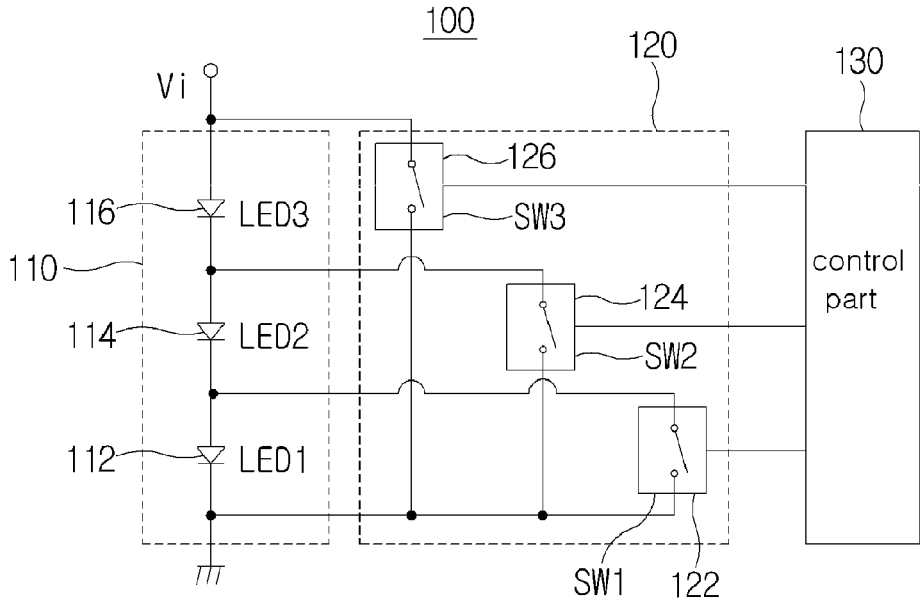
FIG. 1 is a schematic view showing an operation of an LED lighting apparatus according to one embodiment of the present invention.
Figure 2:
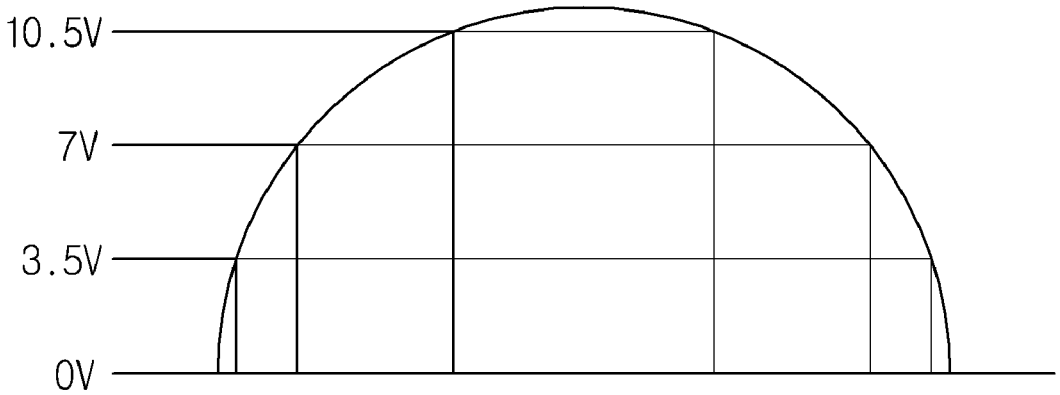
FIG. 2 is a view of a wave form of a full-wave rectified voltage to explain FIG. 1.

FIG. 1 is a schematic view showing an operation of an LED lighting apparatus according to one embodiment of the present invention, and FIG. 2 is a view of a wave form of a full-wave rectified voltage to explain FIG. 1.

As shown in FIG. 1, an LED lighting apparatus 100 includes an LED part 110, a driving part 120 and a control part 130.

The LED part 110 includes an LED1 112, an LED2 114 and an LED3 116 which are connected in series. A driving voltage V1 is supplied to an anode of the LED3 116, and a cathode of the LED1 112 is connected to a ground terminal. Herein, the driving voltage V1 has a wave form of full-wave rectified voltage as shown in FIG. 2.

The driving part 120 includes a first switching device SW1 122, a second switching device SW2 124 and a third switching device SW3 126 which supplies or blocks, in turn, a light emitting current to the LED1 112, the LED2 114 and the LED3 116 of the LED part 110. The first switching device SW1 122 is connected with the anode of the LED 1 112 and the ground terminal, the second switching device SW2 124 is connected with the anode of the LED2 114 and the ground terminal, and the third switching device SW3 126 is connected with an anode of the LED3 116 and the ground terminal.

The control part 130 outputs control signal which turns on or off the first switching device SW1 122, the second switching device SW2 124 and the third switching device SW3 126, respectively.

Hereinafter, the operation of the LED lighting apparatus 100 of FIG. 1 will be described.

For convenience of explanation, all of the LED1 112, LED2 114 and LED3 116 of the LED part 110 are regarded as a single LED.

First of all, assuming that a light-emitting voltage for turning on each of the LED1 112, LED2 114 and LED3 116 of the LED part 110 is 3.5V, the driving voltage V1 supplied to the anode of the LED3 116 has to be 10.5V or more in order to turn on all of the LED1 112, LED2 114 and LED3 116.

That is, if the driving voltage V1 supplied to the anode of the LED3 116 is 10.5V or more, for example in a section of 10.5V or more shown in FIG. 2, the control part 130 outputs an off signal to the first switching device SW1 122, the second switching device SW2 124 and the third switching device SW3 126 so that all of the first switching device SW1 122, the second switching device SW2 124 and the third switching device SW3 126 are switched off.

However, if the driving voltage V1 supplied to the anode of the LED3 116 is 10.5V or less, for example in a section of 7V~10.5V in FIG. 2, all of the LED1 112, LED2 114 and LED3 116 cannot be turned on, and thus the control part 130 outputs an on signal to the first switching device SW1 122 so that the first switching device SW1 122 is switched on. In this case, a both-end voltage of the first switching device SW1 122 is 0V, and thus a voltage applied to the anode of the LED1 112 is also 0V. However, since the driving voltage V1 larger than the light-emitting voltage is supplied to the LED2 114 and the LED3 116, the LED2 114 and the LED3 116 can be continuously turned on.

Moreover, if the driving voltage supplied to the anode of the LED3 116 is further lowered and thus it is 7V or less, for example in a section of 3.5-7V, both of the LED2 114 and the LED3 116 cannot be turned on, and thus the control part 130 outputs an on signal to the second switching device SW2 124 of the driving part 120 so that the second switching device SW2 124 is switched on. In this case, a both-end voltage of the second switching device SW2 124 is 0V, and thus a voltage applied to the anode of the LED2 114 is also 0V. However, since the driving voltage V1 larger than the light-emitting voltage is supplied to the LED3 116, the LED3 116 can be continuously turned on.

However, if the driving voltage supplied to the anode of the LED3 116 is further lowered and thus it is 3.5V or less, for example in a section of 3.5 or less, the LED3 116 cannot be turned on, and thus the control part 130 outputs an on signal to the third switching device SW3 126 of the driving part 120 so that the third switching device SW3 126 is switched on. Therefore, the driving current supplied to the LED3 116 is blocked and all of the LED1 112, the LED2 114 and the LED3 116 are turned off.

If the driving voltage supplied to the anode of the LED3 116 is increased from 0V, the control part 130 outputs the on signal so as to switch on, in turn, the third switching device SW3 126, the second switching device SW2 124 and the first switching device SW1 122, thereby turning on, in turn, the LED3 116, the LED2 114 and the LED1 112.

Figure 3:
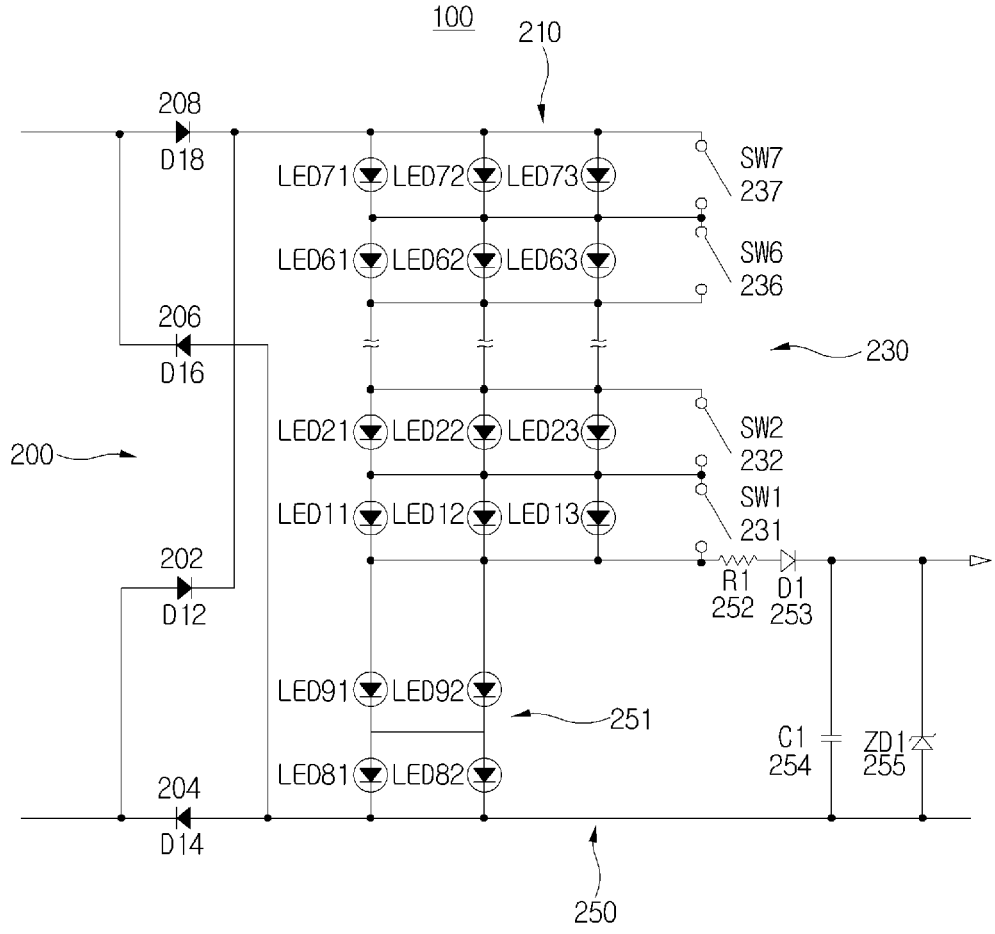
FIG. 3 is a view showing a principle of generating a DC voltage in the LED lighting apparatus according to one embodiment of the present invention.
Figure 4:
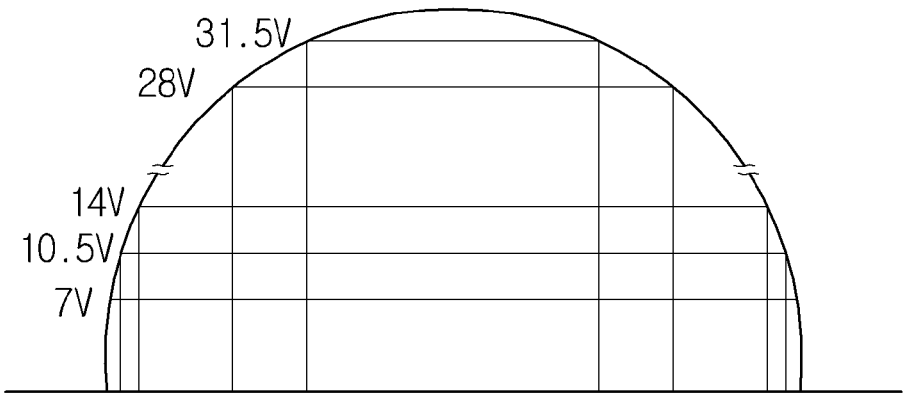
FIG. 4 is a view showing a wave form of a full-wave rectified voltage to explain FIG. 3.

FIG. 3 is a view showing a principle of generating a DC voltage in the LED lighting apparatus according to one embodiment of the present invention, and FIG. 4 is a view showing a wave form of a full-wave rectified voltage to explain FIG. 3.

The LED lighting apparatus 100 includes a rectifier circuit part 200, an LED part 210, a driving part 220 and a DC voltage generating part 250.

The rectifier circuit part 200 is to full-wave rectify a commercial power and comprised of a diode D12 202, a diode D14 204, a diode D16 206 and a diode D18 208.

In the LED part 210, a plurality of LEDs 11~73 are electrically connected in the form of columns and rows of a matrix.

The driving part 220 includes a switching device SW1 221 for turning on or off the LED11, the LED 12 and the LED 13, a switching device SW2 222 for turning on or off the LED21, the LED 22 and the LED 23, a switching device SW6 226 for turning on or off the LED61, the LED 62 and the LED 63, and a switching device SW7 227 for turning on or off the LED71, the LED 72 and the LED 73. In FIG. 3, the switching devices SW1 221, SW2 222, SW6 226 and SW7 227 are connected to each of both ends of the LEDs connected in parallel, but they may be connected in the type shown in FIG. 1.

The DC voltage generating part 250 is provided with a voltage-forming LED circuit 251 which is used to emit light and also to obtain a DC voltage, a zener diode ZD1 255 for generating a desired voltage Vcc, and a condenser C1 254 for maintaining a rated voltage of the zener diode ZD1 255. Further, the DC voltage generating part 250 is also provided with a resistor R1 252 which is disposed between the voltage-forming LED circuit 251 and the zener diode ZD1 255 so as to eliminate a difference between the both-end voltage of the voltage-forming LED circuit 251 and the rated voltage of the zener diode ZD1 255. The voltage-forming LED circuit 251 is comprised of an LED81, an LED 82, an LED 91 and an LED 92 which are connected in the form of a matrix.

Meanwhile, in order to use a low capacity condenser C1 254 and obtain a constant voltage having a low ripple level, a voltage charged in the condenser C1 254 should not be consumed in the voltage-forming LED circuit 251. To this end, the DC voltage generating part 250 may further include a diode D1 253 between the voltage-forming LED circuit 251 and the condenser C1 254.

Further, as shown in FIG. 3, the number (two) of voltage-forming LEDs which are connected in parallel in the DC voltage generating part 250 is smaller than the number (three) of LEDs which are connected in parallel in the LED part 210. Preferably, the combination of the numbers is varied according to a kind of used current. Thus, a proper current can flow through the voltage-forming LEDs, and at the same time, the DC voltage generating part 250 can obtain a necessary current.

Hereinafter, the principle of generating the DC voltage in the LED lighting apparatus shown in FIG. 3 will be described.

If an AC voltage is continuously supplied to the rectifier circuit part 200, the rectifier circuit part 200 outputs a full-wave rectified voltage rectified by the diodes 202, 204, 206 and 208, and the rated voltage (e.g., 6V) of the zener diode ZD1 255 is maintained at both ends of the condenser C1 254 by the full-wave rectified voltage.

More detailedly, it will be described about a case that the wave form shown in FIG. 4 is continuously supplied to the rectifier circuit part 200 in a state that the constant voltage generated by the rated voltage of the zener diode ZD1 255 is maintained by the condenser C1 254.

First of all, since the switching devices of the driving part 220 are switched on within a full-wave rectified voltage range of 0V ~7V and the voltage-forming LEDs (LED81, LED 91 and LED 92) of the DC voltage generating part 250 cannot be driven, the plurality of LEDs of the LED part 210 and the voltage-forming LEDs of the DC voltage generating part 250 are all turned off.

If the full-wave rectified voltage is 7V or more, the voltage-forming LEDs of the DC voltage generating part 250, and a charging current for replenishing a discharged voltage in the condenser C1 254 is supplied through the resistor R1 252 and the diode D1 253 in the meantime. Therefore, the rated voltage of the zener diode ZD1 255, i.e., 6V is maintained at both ends of the condenser C1 254.

If the full-wave rectified voltage is 10.5V or more, the switching device SW1 221 is switched off, and the LED11, LED 12 and LED 13 of the LED part 210 are turned on. By such the principle, if the rectified voltage is risen, more LEDs of the LED part 210 can be turned on.

Meanwhile, in FIG. 3, the electric power may be unnecessarily consumed by the resistor R1 252. However, since the voltage applied to the resistor R1 is about 1V, the consumed power is only 0.02 W (1V×20 mA).

Figure 5:
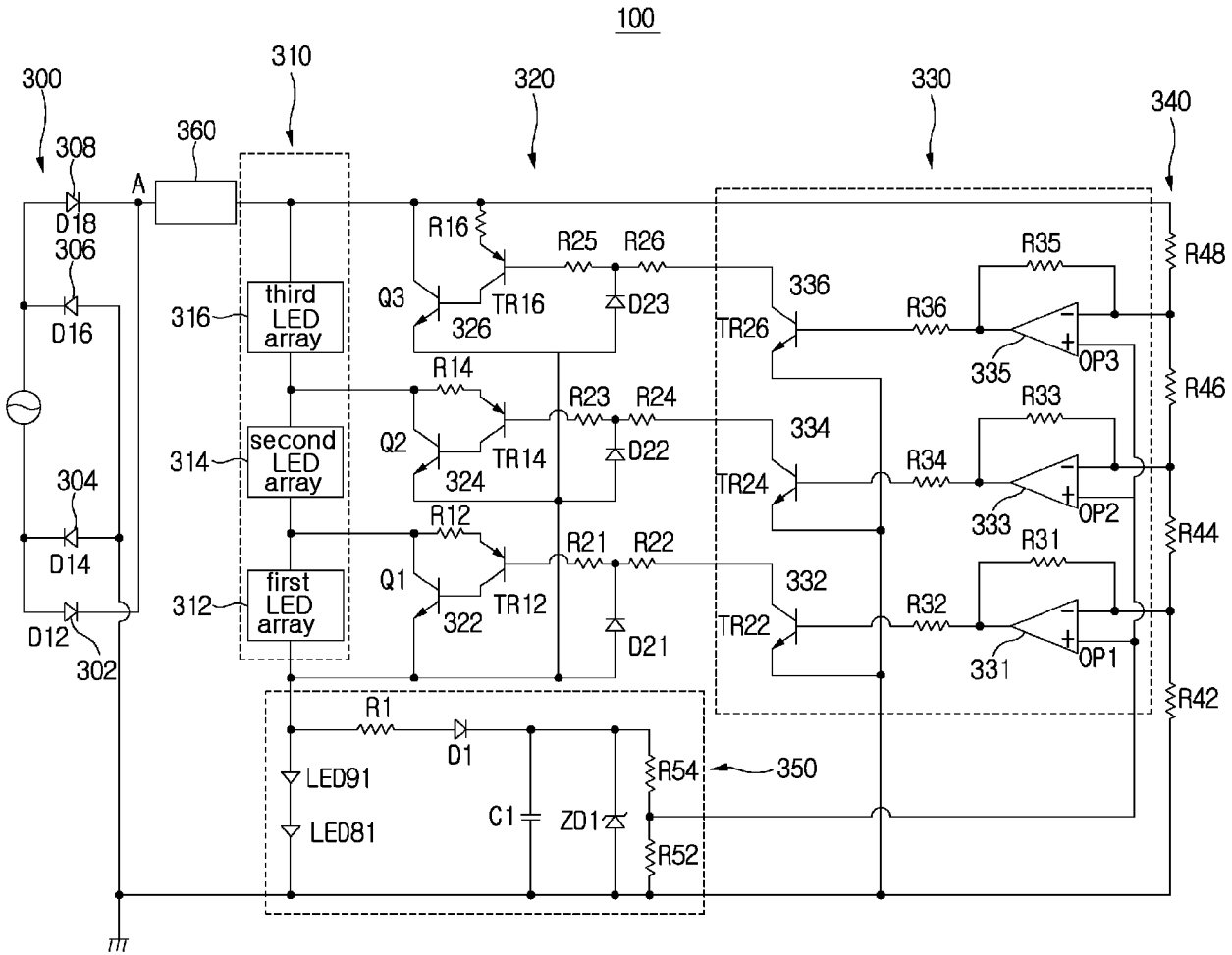
FIG. 5 is a view showing a detailed configuration of the LED lighting apparatus according to one embodiment of the present invention.

FIG. 5 is a view showing a detailed configuration of the LED lighting apparatus according to one embodiment of the present invention.

As shown in FIG. 5, the LED lighting apparatus using the commercial power such as AC 220V includes a rectifier circuit part 300, an LED part 310, a driving part 320, a control part 330, a DC voltage generating part 350 and a constant current circuit part 360.

The rectifier circuit part 300 is to full-wave rectify the commercial power and comprised of a diode D12 302, a diode D14 304, a diode D16 306 and a diode D18 308.

The LED part 310 is comprised of a plurality of LED arrays. For convenience of explanation, it is regarded that the LED part 310 is comprised of a first LED array 312, a second LED array 314 and a third LED array 316.

Figure 6:
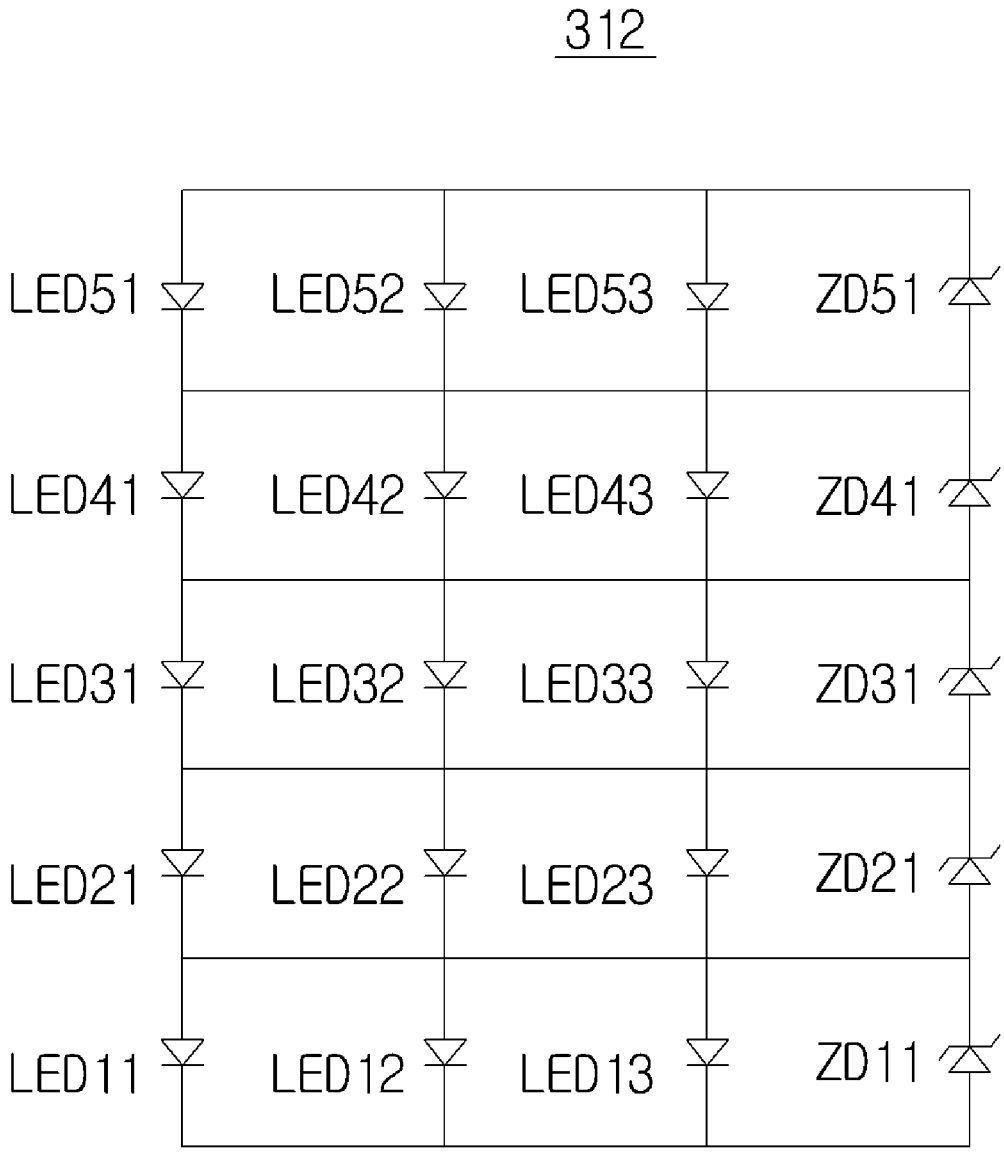
FIG. 6 is a view showing a detailed configuration of an LED array used in the LED lighting apparatus of FIG. 5.

FIG. 6 is a view showing a detailed configuration of an LED array used in the LED lighting apparatus of FIG. 5.

Each of the LED arrays 312, 314 and 316 is comprised of a plurality of LEDs, or may be comprised of white LEDs. However, as shown in FIG. 6, it is preferable that the LED arrays 312, 314 and 316 are comprised of the plurality of LEDs 11~53 which are electrically connected in the form of columns and rows of a matrix.

That is, in a connecting method of the plurality of LEDs 11~53, five LEDs, i.e., the LED11, LED 21, LED 31, LED 41 and LED 51 are electrically connected in series, and anodes of the LED 51, LED52 and LED 53 in a first line are electrically connected with each other, and cathodes of the LED11, LED12 and LED 13 of a last line are electrically connected with each other.

In the connecting method, however, if only a single one of the five LEDs connected in series fails, the line cannot emit the light. Therefore, in a preferable embodiment a shown in FIG. 6, it is preferable that the nodes of the five LEDs connected in series are connected again in parallel in the form of columns and rows of a matrix. In this case, even though one of the five LEDs, e.g., the LED32 is disconnected, other LEDs are not affected and thus the illumination intensity is not lowered remarkably.

Further, as shown in FIG. 6, the zener diode is connected to every column of the LED matrix in a reverse direction. That is, the cathode of the zener diode ZD51 is connected to the anode of the LED 51 in parallel, and the anode of the zener diode ZD51 is connected to the cathode of the LED 51 in parallel. In this case, it is preferable that a breakdown voltage of the zener diode is slightly larger than the light-emitting voltage of the LED.

Meanwhile, in FIG. 6, the LED arrays 312, 314 and 316 are arranged in a 5×3 matrix, but the present invention is not limited to this embodiment. Further, the number of the LED arrays 312, 314 and 316 may be appropriately selected according to an input voltage of the commercial power.

The driving part 320 includes a first switching circuit 322, a second switching circuit 324 and a third switching circuit 326 which supplies or blocks, in turn, a driving current to the first, second and third LED arrays 312, 314 and 316 of the LED part 310.

The first switching circuit 322 is connected with an anode terminal of the first LED array 312 and a relative ground terminal, the second switching circuit 324 is connected with an anode terminal of the second LED array 314 and the relative ground terminal, and the third switching circuit 326 is connected with an anode terminal of the third LED array 316 and the relative ground terminal. Herein, the relative ground terminal is a voltage which is increased from an absolute ground point of an actual circuit due to the DC voltage generating part 350, and indicates an area to which one ends of the first, second and third switching circuits 322, 324 and 326 are commonly connected.

In other words, each emitter of a first, second and third switching transistors Q1, Q2 and Q3 is connected to the cathode of the first LED array 312.

Meanwhile, as shown in FIG. 3, each collector of the switching transistors (not shown) may be connected with each anode of the LED arrays 312, 314 and 316, and each emitter of the switching transistors may be connected with each cathode of the LED arrays 312, 314 and 316. However, in case of the switching transistors which are respectively connected with the LED arrays 312, 314 and 316 in parallel, since the switching transistors are connected in series, the unnecessary power consumption is occurred due to a sum of on-voltages applied to both ends of each switching transistor and a driving current Io, whenever the switching transistors are turned on.

Meanwhile, the connection of the first, second and third switching transistors Q1, Q2 and Q3 shown in FIG. 5 can prevent the unnecessary power consumption which may be occurred at the connection of the switching devices of FIG. 3. That is, in case of the first, second and third switching transistors Q1, Q2 and Q3 shown in FIG. 5, the power consumption is occurred only by the on-voltage applied to both ends of one switching transistor and the driving current Io, and thus the unnecessary power consumption which may be occurred in FIG. 3 is prevented.

Each switching circuit 322, 324, 326 is the same in FIG. 5, and thus the first switching circuit 322 will be described as an example.

The first switching circuit 322 is comprised of a level shift circuit including the first switching transistor Q1 which is a semiconductor device as an example of the switching device of FIG. 1, and a transistor TR12, a resistor R12, a resistor R21, a resistor 22 and a diode D21 which turn on the first switching transistor Q1 and shift a voltage level.

And FIG. 5 shows only the first switching transistor Q1 as the switching device 122 of FIG. 1, but the same switching transistor (not shown) may be further connected to be parallel with the first switching transistor Q1. Preferably, a DMOS (Double Diffused MOS) transistor having low on-resistance is used as the switching transistors Q1, Q2 and Q3.

The control part 330 outputs control signal which switches on or off the first, second and third switching circuits 322, 324 and 326 of the driving part 320, respectively. That is, the control part 330 includes a first comparator 331 and a transistor TR22 332 which control the first switching circuit 322, a second comparator 333 and a transistor TR24 334 which control the second switching circuit 324, and a third comparator 335 and a transistor TR26 336 which control the third switching circuit 326.

The comparators 331, 333 and 335 have the same configuration, and the first comparator 331 is comprised of an operational amplifier OP1 and a resistor R31, R32.

Further, the control part 330 may include a level detecting circuit 340. The level detecting circuit 340 detects a full-wave rectified voltage level, i.e., a phase value of the rectifier circuit part 300 so as to turn on or off each of the LED arrays 312, 314 and 316.

As shown in FIG. 5, the level detecting circuit 340 is comprised of the resistors R42, R44, R46 and R48 so as to detect the full-wave rectified voltage level. Therefore, in the level detecting circuit 340, the voltage is distributed and applied to each node among the resistors R42, R44, R46 and R48 according to the rectified voltage level. The distributed voltage is supplied to the inverting terminals of the operational amplifiers.

The DC voltage generating part 350 is connected between the absolute ground terminal and the first LED array 212 of the LED part 210. The DC voltage generating part 350 is provided with an LED 81 and an LED 91 which can emit the light together with the plurality of LEDs of the LED part 210 and also can obtain the distributed voltage as the full-wave rectified voltage.

The DC voltage generating part 350 may include the zener diode ZD1 and the condenser C1 so as to generate the constant voltage Vcc. Further, the DC voltage generating part 350 generates a reference voltage Vref through the resistors R52 and R54 and then supplies the reference voltage Vref to the non-inverting terminals of the operational amplifiers of the control part 330.

The constant current circuit part 360 functions to constantly maintain the current flowing through the LED arrays 312, 314 and 316 of the LED part 360 and also to protect from an excess current. The constant current circuit part 360 is connected to the rectifier circuit part 300 and the anode of the third LED array 316 as the uppermost LED array of the LED part 310.

Figure 7:
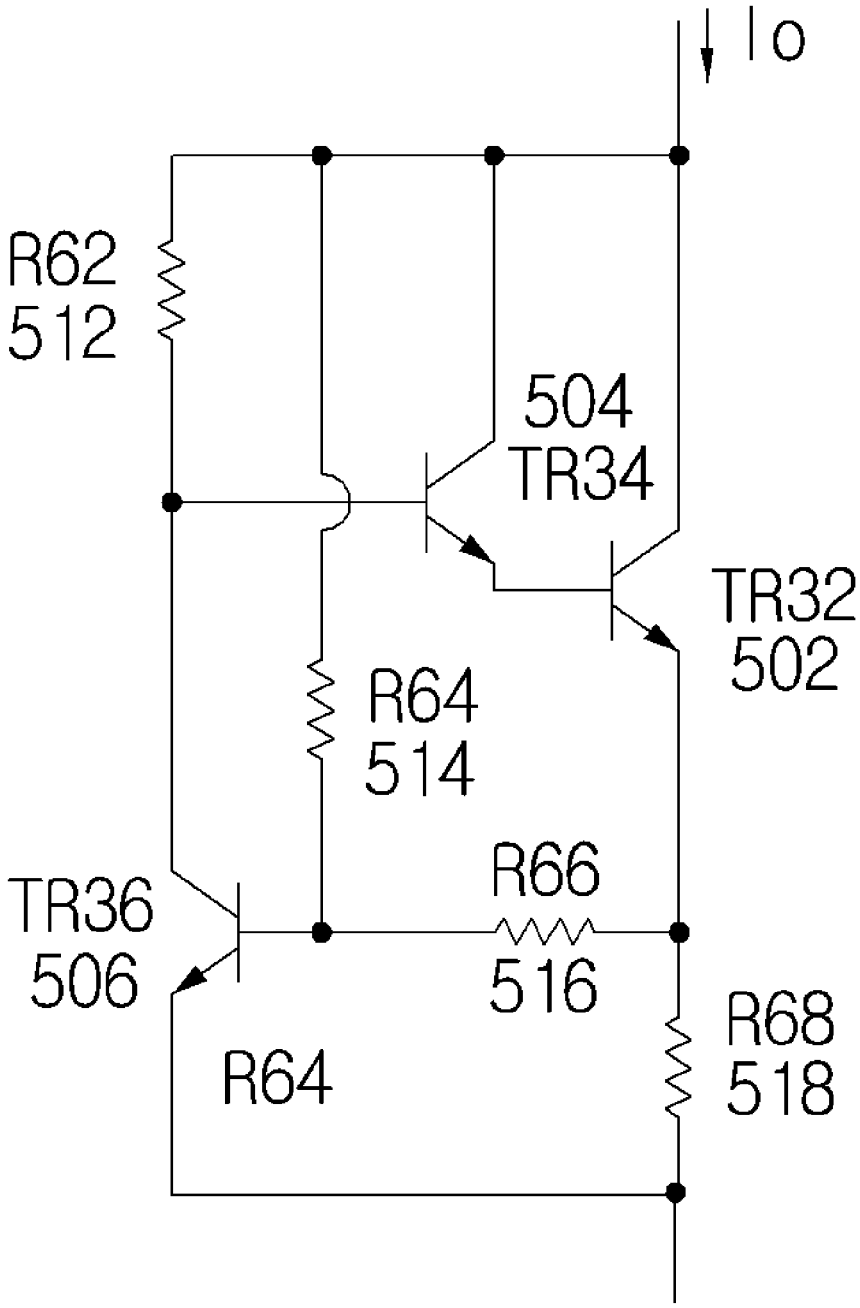
FIG. 7 is a view showing a detailed configuration of a constant current circuit part used in the LED lighting apparatus of FIG. 5.
Figure 8:
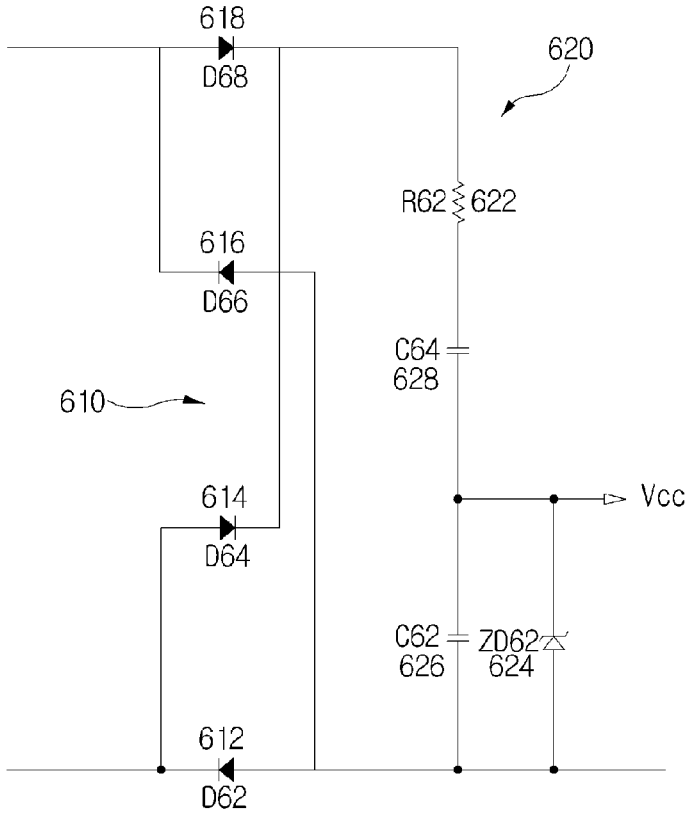
FIG. 8 is a view showing a principle of generating a DC voltage using a general full-wave rectifier circuit.
Figure 9:
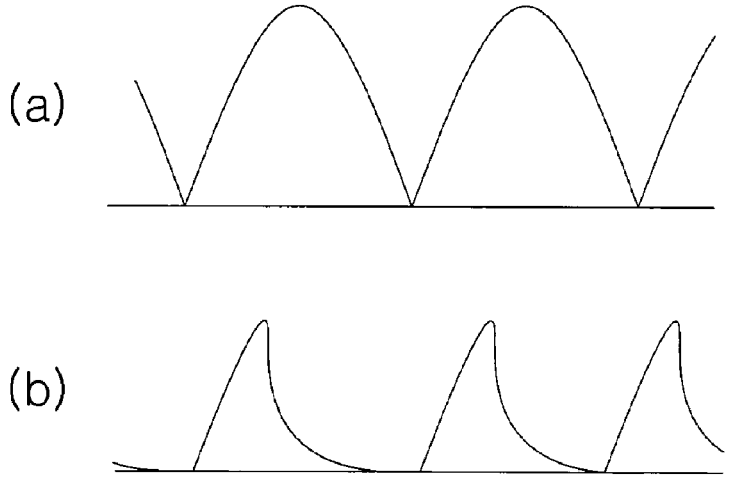
FIG. 9 shows wave forms of current and commercial power supplied to the full-wave rectifier circuit of FIG. 8.

FIG. 7 is a view showing a detailed configuration of a constant current circuit part used in the LED lighting apparatus of FIG. 5.

As shown in FIG. 7, the constant current circuit part 360 is comprised of a transistor TR32 502, a transistor TR34 504, a transistor TR36 506 and resistors R62 512, R64 514, R66 516 and R68 518.

One end of the resistor R62 512 is connected to collectors of the transistors TR 32 502 and TR34 504, and the other end thereof is connected to a base of the transistor TR34 504 and a collector of the transistor TR36 506. Meanwhile, one end of the resistor R64 514 is connected to the collectors of the transistors TR 32 502 and TR34 504, and the other end thereof is connected to a base of the transistor TR36 506. And an emitter of the transistor TR34 504 is connected to a base of the transistor TR32 502.

Meanwhile, the resistor R66 516 is connected between the emitter of the transistor TR32 502 and the base of the transistor TR36 506, and the resistor R68 518 is connected between the emitter of the transistor TR36 506 and the emitter of the transistor TR32 502.

If the full-wave rectified voltage output from the rectifier circuit part 300 is supplied, the current flows through the resistor R62 512, and the transistor TR34 504 is turned on, and thus the transistor TR36 506 is turned on. Meanwhile, since the transistors TR34 504 and TR36 506 are connected in Darlington connection, an amplification degree is high.

If the current flowing through the resistor R68 518 is increased, the voltage is also increased, and thus the current flowing through the resistor R66 516 is increased. Therefore, a voltage Vbe between the base and the emitter of the transistor TR36 506, and the transistor TR36 506 is turned on, and at the same time, a base current of the transistor TR34 504 is reduced.

Further, the full-wave rectified voltage output from the rectifier circuit part 300 is connected to the base of the transistor TR36 506 through the resistor R64 514. Therefore, if the full-wave rectified voltage is increased, the voltage Vbe between the base and the emitter of the transistor TR36 506 through the resistor R64 506 is increased, thereby reducing the driving current Io. Accordingly, the constant current circuit part 360 can supply the constant current to the LED part 310, even though the full-wave rectified voltage output from the rectifier circuit part 300 is increased.

If the current flowing through the resistor R68 518 is further increased due to excess current, the voltage Vbe between the base and the emitter of the transistor TR36 506 is also increased, and the transistor TR34 504 is turned off, and thus the transistor TR32 502 is turned off. Therefore, the current flowing through the LED part 310 is restricted, and thus the LED lighting apparatus 100 can be protected from the excess current.

Hereinafter, the operation of the LED lighting apparatus 100 shown in FIG. 5 will be described.

If the commercial power, e.g., 220V is supplied, the commercial power is full-wave rectified. In this case, if a full-wave rectified voltage of 0V is output with the ground terminal as a reference point, it is impossible to turn on the plurality of LEDs provided at the LED arrays 312, 314 and 316 with the driving voltage supplied to each of the LED arrays 312, 314 and 316. Therefore, the switching transistors Q1, Q2 and Q3 of the driving part 330 should be turned on.

In other words, if the full-wave rectified voltage of 0V is output with the ground terminal as the reference point, 0V is supplied to the inverting terminal of each comparator 331, 333, 335 of the control part 330, and a reference voltage Vref larger than 0V, e.g., 6V is supplied to the non-inverting terminal of each comparator 331, 333, 335. Therefore, each comparator 331, 333, 335 outputs H signal, and L signal is output to each collector of the transistors TR22 332, TR24 334 and TR36 336. The transistors TR12, TR14 and TR16 of the driving part 330 are turned on by the L signal, and thus the switching transistors Q1, Q2 and Q3 are turned on.

And it will be described about a case that the full-wave rectified voltage is larger than the driving voltage, which can turn on one of the LED arrays 312, 314 and 316, with the ground terminal as the reference point.

If the full-wave rectified voltage is larger than the driving voltage which can turn on one of the LED arrays 312, 314 and 316, a distributed voltage is formed at each node point of the resistors R42, R44, R46 and R48 of the level detecting circuit in proportion to the resistant value and then provided at the non-inverting terminals of the operational amplifiers of the control part 330. Herein, since a higher voltage than the reference voltage Vref is provided at the non-inverting terminal of the operational amplifier of the comparator 335 in which the highest distributed voltage is provided, the comparator 335 outputs the L signal, and the H signal is output to the transistor TR26 336. The transistor TR16 of the driving part 330 is turned off by the L signal, and thus the switching transistor Q3 is also turned off. Therefore, the plurality of LEDs of the third LED array 316 of the LED part 310 is turned on.

And it will be described about a case that the full-wave rectified voltage is larger than the driving voltage, which can turn on the two of the LED arrays 312, 314 and 316, with the ground terminal as the reference point.

If the full-wave rectified voltage is larger than the driving voltage which can turn on the two of the LED arrays 312, 314 and 316, a distributed voltage is formed at each node point of the resistors R42, R44, R46 and R48 of the level detecting circuit in proportion to the resistant value and then provided at the non-inverting terminals of the operational amplifiers of the control part 330. In this case, since a higher voltage than the reference voltage Vref is provided at the non-inverting terminal of the operational amplifier of the comparator 333 in which the second highest distributed voltage is provided, the comparator 333 outputs the L signal, and the H signal is output to the transistor TR24 334. The transistor TR14 of the driving part 330 is turned off by the L signal, and thus the switching transistor Q2 is also turned off. Therefore, since the plurality of LEDs of the second LED array 314 of the LED part 310 is turned on, the illumination intensity is increased more than when only the third LED array 316 is turned on.

Further, it will be described about a case that the full-wave rectified voltage is larger than the driving voltage, which can turn on all of the LED arrays 312, 314 and 316, with the ground terminal as the reference point.

If the full-wave rectified voltage is larger than the driving voltage which can turn on all of the LED arrays 312, 314 and 316, a distributed voltage is formed at each node point of the resistors R42, R44, R46 and R48 of the level detecting circuit in proportion to the resistant value and then provided at the non-inverting terminals of the operational amplifiers of the control part 330. And, since a higher voltage than the reference voltage Vref is provided at the non-inverting terminal of the operational amplifier of the last remaining comparator 331, the comparator 331 outputs the L signal, and the H signal is output to the transistor TR26 336. The transistor TR12 of the driving part 330 is turned off by the L signal, and thus the switching transistor Q1 is also turned off. Therefore, all of the first, second and third LED arrays 312, 314 and 316 of the LED part 310 is turned on.

Meanwhile, if the full-wave rectified voltage is reduced with the ground terminal as the reference point, the switching transistors Q1, Q2 and Q3 are turned on in reverse order of the above-mentioned process, and thus the first, second and third LED arrays 312, 314 and 316 are turned on in turn.

While the present invention has been described with respect to the specific embodiments, it will be apparent to those skilled in the art that various changes and modifications may be made without departing from the spirit and scope of the invention as defined in the following claims.

The present invention provides the LED lighting apparatus in which the full-wave rectified wave form of the commercial power is used as the driving voltage, it is possible to improve the power factor and also to reduce the power consumption.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A power-saving LED lighting apparatus, comprising:

a rectifier circuit part which full-wave rectifies commercial power and outputs a rectified voltage;

an LED part in which a plurality of LED arrays having a plurality of LEDs are connected in series and the rectified voltage of the rectifier circuit part is supplied to an anode of the uppermost LED array;

a driving part which is provided with a plurality of switching devices for supplying or blocking a driving current to the plurality of LED arrays, wherein one terminal of each switching device among the plurality of switching devices is connected to each corresponding anode of the plurality of LED arrays, and the other terminal thereof is connected to a cathode of the lowermost LED array together; and a control part which outputs a control signal for turning on and off the switching devices of the driving part according to a level of the rectified voltage of the rectifier circuit part, wherein the driving part further comprises a level shift circuit which shifts the control signal output from the control part to control the plurality of the switching devices.

2. The LED lighting apparatus according to claim 1, further comprising a constant current circuit part which is connected between the rectifier circuit part and the anode of the uppermost LED array of the LED part.

3. The LED lighting apparatus according to claim 1, wherein the driving part is comprised of transistors in which the plurality of switching devices are connected in parallel.

4. The LED lighting apparatus according to claim 1, wherein each of the LED arrays has a plurality of LEDs which are connected in the form of columns and rows of a matrix.

5. The LED lighting apparatus according to claim 4, wherein a zener diode is further connected to each column of the LEDs, which are connected in the form of columns and rows of the matrix, in a reverse direction.

6. The LED lighting apparatus according to claim 1, wherein the control part has a plurality of comparators which output a control signal for turning on and off the plurality of switching devices of the driving part according to a level of the rectified voltage of the rectifier circuit part.

7. A power-saving LED lighting apparatus comprising:

a rectifier et which full-wave rectifies commercial power and outputs a rectified voltage;

an LED part in which a plurality of LED arrays having a plurality of LEDs are connected in series and the rectified voltage of the rectifier circuit part is supplied to an anode of the uppermost LED array;

a driving part in which one terminal of each switching device for supplying or blocking a driving current to the plurality of LED arrays is connected to each anode of the plurality of LED arrays, and the other terminal thereof is connected to a cathode of the lowermost LED array;

a control part which outputs a control signal for turning on and off the switching devices of the driving part according to a level of the rectified voltage of the rectifier circuit part, and wherein the control part has a plurality of comparators which output a control signal for turning on and off the switching devices of the driving part according to a level of the rectified voltage of the rectifier circuit part.

8. The LED lighting apparatus according to claim 7, wherein each of the comparators comprises an operational amplifier having an inverting terminal and a non-inverting terminal, and a constant reference voltage is provided at the non-inverting terminal of the operational amplifier, and the rectified voltage of the rectifier circuit part is distributed to the inverting terminal.

9. The LED lighting apparatus according to claim 8, wherein the voltage supplied to the non-inverting terminal of the operational amplifier is a distributed voltage obtained using resistors which are connected in series between the rectified voltage of the rectifier circuit part and the ground terminal.

10. A power-saving LED lighting apparatus, comprising:

an LED part in which a plurality of LED arrays having a plurality of LEDs are connected in series;

a rectifier circuit part which full-wave rectifies commercial power and supplied a full-wave rectified voltage to an anode of the uppermost LED array with a ground terminal as a reference point;

a DC voltage generating part which generates a DC voltage using one or more voltage-forming LEDs connected between the ground terminal and a cathode of the lowermost LED array of the LED part;

a driving part which is provided with switching devices for supplying or blocking a driving current to the plurality of LED arrays; and a control part which outputs a control signal for turning on and off the switching devices of the driving part according to a level of the rectified voltage of the rectifier circuit part.

11. The LED lighting apparatus according to claim 10, further comprising a constant current circuit part which is connected between the rectifier circuit part and the anode of the uppermost LED array of the LED part.

12. The LED lighting apparatus according to claim 10, wherein the control part has a plurality of comparators which output a control signal for turning on and off the switching devices of the driving part according to a level of the rectified voltage of the rectifier circuit part.

13. The LED lighting apparatus according to claim 10, wherein the DC voltage generating part is further provided with a zener diode and a condenser so as to constantly maintain the DC voltage.

14. The LED lighting apparatus according to claim 13, wherein the DC voltage generating part is further provided with a diode between the condenser and one or more voltage-forming LEDs in order to prevent a charged voltage of the condenser from being discharged by the one or more voltage-forming LEDs.

15. The LED lighting apparatus according to claim 13, wherein each of the LED arrays has a plurality of LEDs which are connected in the form of columns and rows of a matrix, and a further voltage-forming LED is parallelly connected to the one or more voltage-forming LEDs, and the number of the parallelly connected one or more voltage-forming LEDs is smaller than the number of the parallelly connected LEDs of the LED part.

* * * * *